US005129165A

United States Patent [19]

Woodle

[11] Patent Number: 5,129,165

[45] Date of Patent: Jul. 14, 1992

[54] CUSTOM TOE CAP FOR BALLET POINTE SHOE AND METHOD OF WEIGHT DISTRIBUTION

[76] Inventor: Alan S. Woodle, 9730 3rd Ave. NE., Ste. 208, Seattle, Wash. 98115

[21] Appl. No.: 605,836

[22] Filed: Oct. 30, 1990

[51] Int. Cl.[5] ..... A43B 5/12

[52] U.S. Cl. ..... 36/8.3; 36/93; 36/88

[58] Field of Search ..... 36/8.3, 93, 113, 88

[56] References Cited

U.S. PATENT DOCUMENTS

| | | | |
|---|---|---|---|
| 1,819,766 | 8/1931 | Capezio | 36/113 X |
| 2,210,304 | 8/1940 | Poole | 36/8.5 |
| 2,810,214 | 10/1957 | Wolfe | 36/113 X |
| 4,026,046 | 5/1977 | Clark | 36/113 |
| 4,120,064 | 10/1978 | Salomon | 36/93 X |
| 4,301,564 | 11/1981 | Dalebout | 36/93 X |
| 4,428,089 | 1/1984 | Dawber | 12/142 |
| 4,520,581 | 6/1985 | Irwin et al. | 36/88 |

FOREIGN PATENT DOCUMENTS

| | | | |
|---|---|---|---|
| 30125 | 11/1931 | Australia | 36/8.3 |
| 136415 | 7/1984 | European Pat. Off. | 36/8.3 |

*Primary Examiner*—Paul T. Sewell
*Assistant Examiner*—BethAnne Cicconi
*Attorney, Agent, or Firm*—Carl G. Dowrey

[57] ABSTRACT

A silicone rubber based custom toe cap for ballet pointe shoes which is molded to fit the tips of relatively shorter toes inside a ballet pointe shoe so as to provide more even weight-bearing across the tips of all toes. The toe cap is fabricated by molding a putty-like settable compound about the ends of the shorter toes utilizing the ballet pointe shoe in place over the toes and moldable compound as a mold resulting in a custom toe cap which conforms exactly to the three dimensional surface and topography of the dancer's toes, the shoe walls and toe platform.

14 Claims, 3 Drawing Sheets

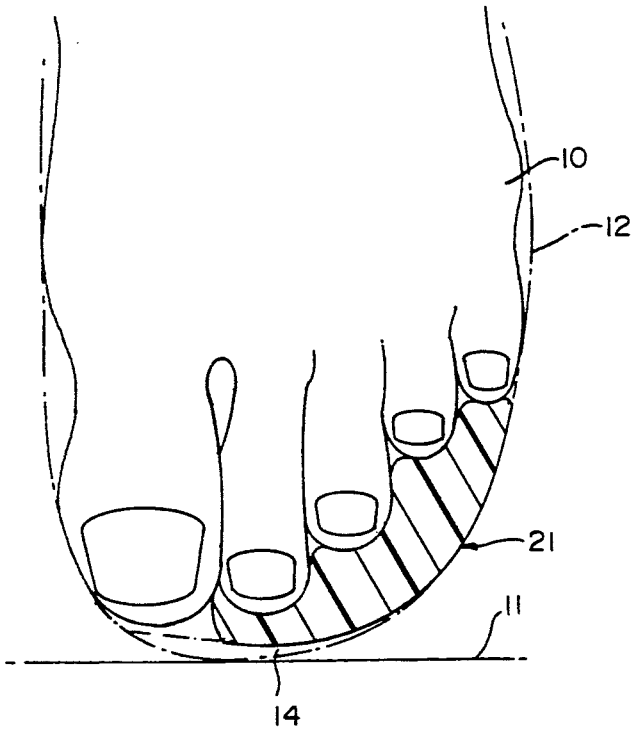
FIG. 4
FIG. 6
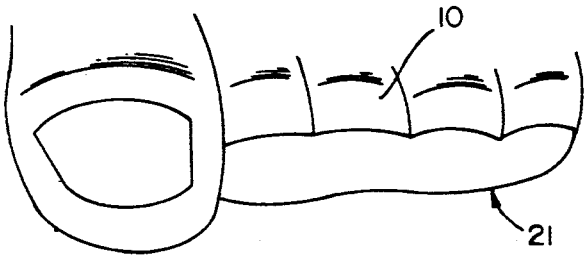
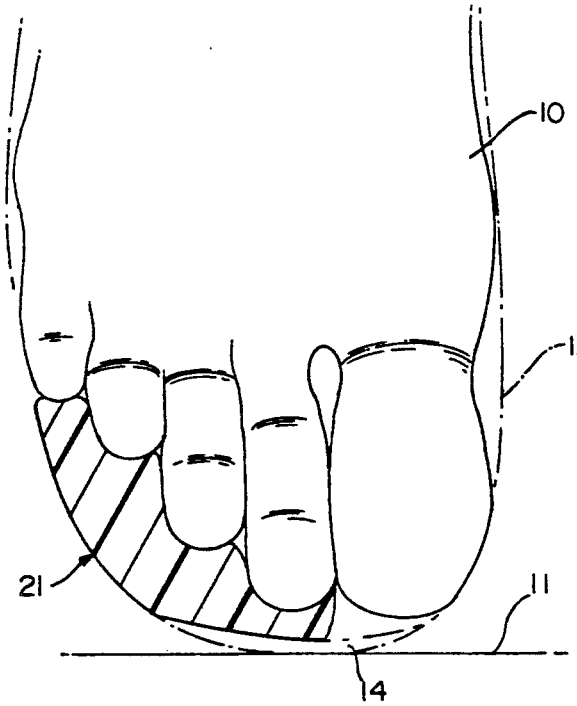
FIG. 5

CUSTOM TOE CAP FOR BALLET POINTE SHOE AND METHOD OF WEIGHT DISTRIBUTION

BACKGROUND OF THE INVENTION

1. Field of the Invention

The present invention relates to a custom fitting ballet pointe shoe toe piece and a method for equalizing the vertical weight bearing distribution across the tips of all toes in all ballet dance positions approximating the pointe position. The custom toe cap acts as an extension of the relatively shorter toes of the dancer with an uneven or irregular toe line and provides a firm, stable yet comfortable support surface inside the pointe shoe.

2. The Prior Art

Ballet dancers have traditionally experienced foot problems as well as dance technique problems due to improper weight distribution at the tip of their toes while in a pointe position. The "pointe position" is the position that ballet dancers assume when they go up on the tips of their toes in a special ballet "pointe shoe". In this position the leg and toes are approximately vertically perpendicular to the dance surface. The dancer's technique or "line" in the pointe position is an imaginary vertical longitudinal straight line extending from the tip of the shoe through the center of the toe platform and up the leg which is considered ideal for balance during ballet dancing. Although the pointe shoe is made with a firm toe box platform at the tip of the shoe providing a firm flat surface on which the dancer balances, serious problems are created by the fact that the toe line of the individual is seldom straight or regular and/or perpendicular to the ideal vertical line along the dancer's leg. The result is unequal weight distribution across the tips of the dancer's toes. Unequal weight distribution may result in extreme discomfort or pain to the dancer. In many cases permanent injury in the nature of toe contractures known as hammertoes, or other serious toe disfigurement results from undue stress. The uneven weight distribution and excessive pressure on the weight bearing toes also results in a number of foot health problems such as stress induced toe buckling or bending, blistering, skin irritation, painful corns, stress fractures, bunions (a bony enlargement of the big toe joint) and ingrown toenails to mention a few.

In addition to the health problems described, the unequal weight distribution may cause the dancer's feet to tilt to one side or "sickle out" through lack of balance resulting in poor technique or "line" in the pointe position. It is not rare that a ballet dancer suffers constant pain, discomfort and disfiguration of the toes in order to compensate for this natural imbalance of pressure on the toes in the pointe position in an effort to maintain acceptable technique or "line".

In the past, the problem described has been in the main accepted as something to be endured for the art. Some efforts have been made in the past to provide a certain amount of cushioning or padding support for the tips of the shorter toes. One such example of toe padding is U.S. Pat. No. 2,210,304 to T.V. Poole which teaches the use of sheepskin or the like with the wool thereon. The Poole patent also discloses the known use of materials such as sponge rubber worn inside the shoe at the tips of the toes. Such devices do not provide a means of weight distribution since they are neither firm nor form fitting. The cushioning is neither stable nor uniform and in most cases offers little or no beneficial results. The longer toes or big toe alone still takes all of the vertical pressure with the undesirable results described.

Another known expedient is the provision of a preformed solid rubber or rubber-like insert in the toe area of dancing shoes such as shown in the Salvio Australian Patent No. 30,125 and the Clark U.S. Pat. No. 4,026,046. Although the Clark patent describes the material as being self molding, the ethane vinyl acetate in this instance must be heated in boiling water to soften and become pliable. The material then returns to its hardened condition. While these types of toe blocks may be made to generally conform to the toe line, they do not take the shape of the three dimensional surface topography of the toes themselves. Additionally, since the toe cap tightly surrounds and encases the toes and end of the foot it creates problems of air circulation and perspiration. For this reason, the Clark patent recommends additional use of cotton around the covered toes to absorb excess moisture.

Also well known is the use of in-situ expanding foams such as low density polyurethane to enclose the foot or a portion of it. Such foams are used to fill the space between the foot surface and the shoe or molding shell. These foam liners are usually left in the shoe and used with ski boots for instance or used to compensate for an abnormal foot formation. The internal configuration of the shoe itself is permanently altered.

The European Patent No. 0,136,415 to Nordi shows still another expedient for filling the space between the dancer's toes and the shoe. A flowable plastic filling is placed inside elastic films which are sealed about their edges. Such devices are subject to punctures and leakage and also result in excessive heat build up from skin contact with the plastic film encasing the filling material.

SUMMARY OF THE INVENTION

According to the present invention a method is provided for establishing a stable weight bearing platform for the relatively shorter toes of a ballet dancer when in the pointe position. According to the novel method a moldable podiatric compound in the form of a soft putty-like substance, preferably a silicone rubber based compound, is mixed with a curing agent and then applied directly to the toes to be supported. With a plastic bag or covering over the compound the foot is placed in its normal position inside the pointe shoe. Standing and pointe position pressure are then applied to the foot causing the compound to flow and fill the spaces between the relatively shorter toes and the ballet point shoe platform. The shoe and protective plastic bag are removed after the compound has taken the three dimensional shape of the space between the shorter toes and the shoe platform as well as the exact three dimensional surface topography of the shorter toes. The compound is then allowed to cure forming a solid dimensionally stable but slightly yieldable toe cap. It is possible to control the durometer value of the moldable compound within a preferred range to render the cured substance of the toe cap soft enough to provide the desired comfort yet firm enough to provide support and to prevent unwanted movement of the toes inside the pointe shoe. Although silicone rubber products have given excellent results, other moldable and settable compounds having equivalent physical properties in the cured state may be used to provide the desirable support. Such materials should also, of course, be compatible with podiatric use.

The toe caps may be trimmed or built up and smoothed as comfort dictates after curing. Once molded, cured and trimmed if necessary, the cap is held in place by the dancer's leotards for insertion in the shoe.

The product made by the process of the present invention is a custom shaped shoe insert or toe cap conforming to the three dimensional surface topography of the dancer's toes as well as the particular pointe shoe and platform. The toe cap is compact, lightweight, transportable and hygienic. The ballet arts have a clear need for such a device which is as old as the art itself and which has never been satisfactorily met. With the present invention pain and discomfort are eliminated while improving the dancer's technique.

BRIEF DESCRIPTION OF THE DRAWINGS

FIG. 4 is a front elevational view of a finished toe cap inside a ballet pointe shoe in the pointe position;

FIG. 5 is a rear elevational view of a finished toe cap inside a ballet pointe shoe in the pointe position;

FIG. 6 is a front end view of a finished toe cap; and

DESCRIPTION OF THE PREFERRED EMBODIMENT

Figure 1:
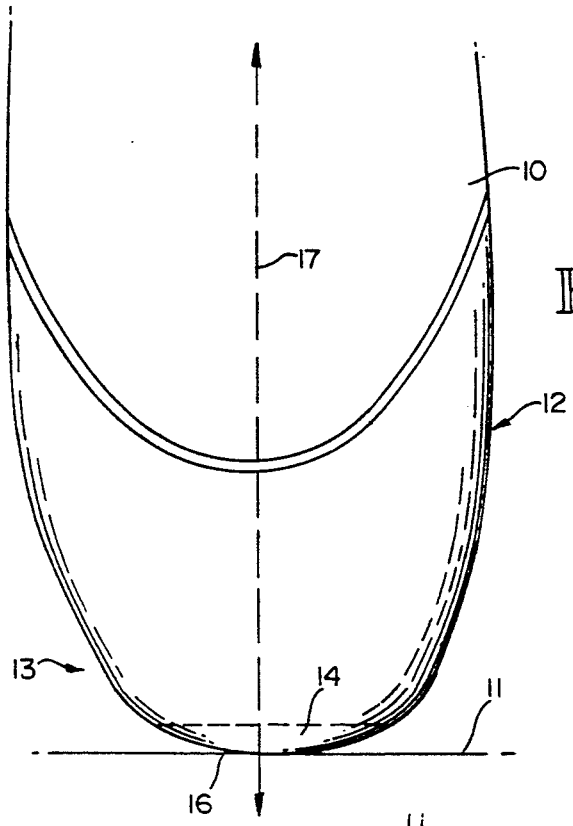
FIG. 1 is a front elevational view of a dancer's shoe and foot in the vertical pointe position.

Referring to FIG. 1, the ballet pointe position is illustrated in which the dancer's foot 10 is oriented substantially vertical at right angles to the floor or dancing platform 11. The ballet shoe 12 which is usually of a lightweight fabric construction is also oriented vertically with the bottom or toe end 13 being provided with a toe box or platform 14 indicated by the dotted lines. The platform provided by the toe box 14 has a substantially flattened or blunted face 16 which contacts the dancing surface 11 and provides the necessary stability for holding the pointe position. The vertical forces exerted through the dancer's leg and toes are directed against the inner face of the toe box. The dancer's technique or "line" in the pointe position is ideally an imaginary vertical longitudinal straight line 17 which extends through the tip of the shoe, through the center of the toe platform and along the dancer's foot and leg. Every effort is made by the dancer to maintain this vertical line while in the pointe position.

Figure 2:
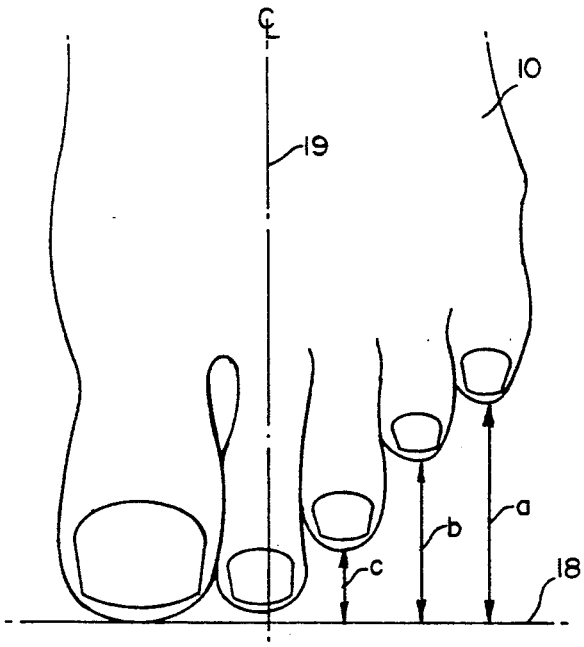
FIG. 2 is a top plan view showing the outline of a dancer's foot in a standing weight-bearing position on a flat surface.

The primary cause of foot problems experienced by ballet dancers in particular is the fact that the line across the face of the person's toes is neither straight nor at right angles to the imaginary line 17. Consequently, the entire vertical force is usually concentrated in the one or two longest toes of the foot. Commonly this is the big toe and the toe adjacent to it. This is not always the case, however, there being a wide variation in the configuration of the human toes. FIG. 2 illustrates a common toe configuration and comprises the plan view of a tracing outline of a typical toe pattern when standing in a normal weight-bearing position barefoot on a flat surface. In FIG. 2 a line 18 has been drawn at right angles to the longitudinal centerline 19 of the person's foot to illustrate a typical offset toe configuration. It will be seen that at least three of the shorter toes are offset a significant distance a, b and c from the line 18. FIG. 2 illustrates the typical problem of weight distribution in the pointe position when the foot is confined in a ballet shoe for instance. In this particular toe configuration, all of the vertical pressure in the pointe position will be concentrated on the big toe and the adjacent toe resulting in extreme discomfort if not pain to the dancer's foot.

Figure 3:
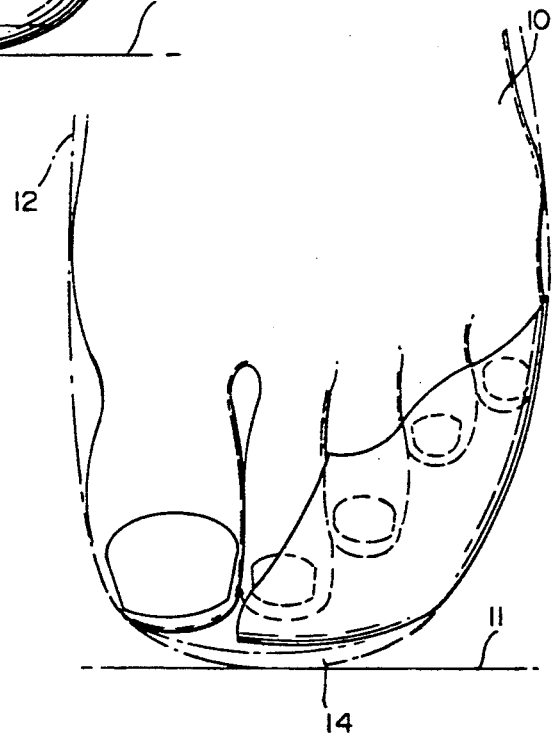
FIG. 3 is a front elevational view of an unmodified toe cap inside a ballet point shoe in the pointe position.
Figure 7:
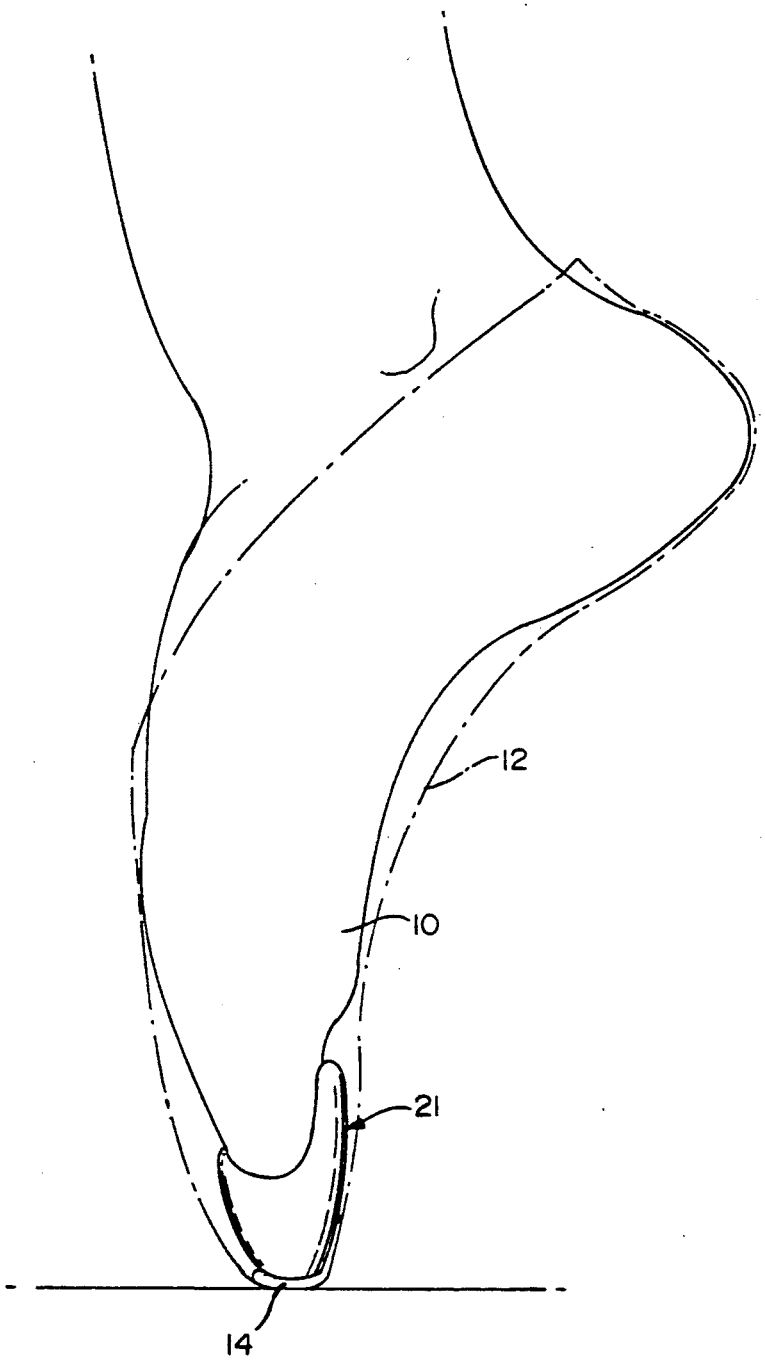
FIG. 7 is a side elevation illustrating the finished toe cap inside a ballet point shoe in the pointe position.

FIGS. 4 through 7 illustrate a custom toe cap of the present invention as applied to a dancer's foot with the toe configuration illustrated in FIG. 2. In FIGS. 4–7 the foot shown is illustrated in the pointe position within a dancing shoe shown in dotted lines. As illustrated in front and rear elevational, FIGS. 4 and 5, the custom toe cap, indicated generally at 21, completely fills the space between the ends of the four shorter toes, the toe box 14 and the wall of the shoe 12, conforming exactly to the three dimensional surface topography. The material of the toe cap 21 may be trimmed away or added to as preferred by the wearer. In the instance illustrated FIGS. 4–7 excess material has been trimmed away to allow the top and bottom surfaces of the toes to be free of the toe cap material. This is a matter of preference, however, and the toe cap may be applied in the original molded configuration if desired. FIG. 3 illustrates the typical untrimmed disposition of the toe cap material which may in most instances flow over the top and bottom surfaces of the toes. The trimming or adding of material to the molded toe cap is dictated by the comfort threshold of the individual dancer.

The physical properties of the cured material are an important feature of the invention. It is essential that the material be dimensionally stable once molded and cured such that there is no flowing or substantial distortion of the material of the toe cap, particularly when the foot is disposed in the pointe position. The inventor has discovered that silicone rubber based compounds in particular provide excellent support for distributing and sustaining the vertical forces across all toes of the foot while having a sufficiently yieldable surface so as to prevent discomfort otherwise experienced from hardened substances such as solid rubber and the like. Silicone rubber based compounds are well known and come in a variety of commercially available forms. These products are in the form of putty-like substances which are settable into dimensionally stable materials with the addition of well known setting agents. These compounds are ideal from the standpoint of podiatric use since many of them are hydrophobic and otherwise compatible with use within the shoe. These materials are hygienic and may be easily cleaned with water or alcohol and do not break down with use so as to be durable as well as convenient and portable. The cured and finished toe cap should have a durometer value of no less than 20 on the Shore-A Hardness scale so as to be slightly yieldable yet prevent any movement of the toe within the shoe in the pointe position. The preferred durometer range is 20 to 40 on the Shore-A Hardness scale. With this range, the best results in the nature of preventing movement of the foot within the shoe and providing a firm platform for weight distribution are obtained. In this range, the material is not so hard as to cause obvious discomfort to the dancer's toes. In practice applicant has obtained excellent results with a commercially available product known as MPC manufactured by North Health Care, 1515 Elmwood Road, Rockford, Ill. 61103. The putty-like or moldable compound is mixed with a curing agent such as dibutyl tin dilaurate ethyl silicate. The curing agent is introduced and kneaded into the putty-like silicone rubber base compound prior to molding and results in the setting of the material within the desired durometer range described. It is well known in the art to use different additives for color and texture in the silicone rubber base product as well as varying the amount and type of curing agent to obtain the desired physical properties including durometer values. Other well known and commercially available silicone rubber base products are BERKOPLAST manufactured by Heinrich Berkemann Company, Hamburg, Germany and POD-O-FORMA II, manufactured by Insta-mold Prosthetics, Inc., Oakes, Pa. All of these products are suitable for molding toe caps according to the present invention within the durometer range described. Although silicone rubber based moldable and settable compositions have been described, other substances may be utilized which are adaptable to the method of molding and fitting to be described and which display the other physical properties described or their equivalent for use in the present invention.

According to the present method, molding and fitting of the custom toe cap does not require specialized equipment since the ballet pointe shoe itself is utilized as the mold and the well known silicone rubber based compounds and curing agents require no special application of heat or the like to cure the material. The silicone rubber based composition is furnished with a small plastic bag into which the curing agent is introduced and mixed with the putty-like compound. Characteristically the setting agent is kneaded into the compound within a closed plastic container for approximately 30 seconds and then the mixture is removed and further kneaded for another approximate 30 seconds to complete the mixing This mixture is then hand applied and molded over the bare foot tips of the relatively shorter toes to ensure that all toe surfaces are contacted. A plastic film or lightweight plastic bag is then placed over the applied mixture and the foot thus covered slid into the ballet pointe shoe. The ballet dancer then stands on a firm flat surface in the pointe position causing the silicone rubber compound to be compressed so as to fill all voids between the ends of the toes, the walls of the shoe and the toe box. It is recommended that the pointe position be held for approximately ten minutes to allow for this portion of the molding process. After this period of pointe position pressure, the dancer then stands flat on her foot without removing the pointe shoe for another approximate 10 minute period. Once the compound has been thus molded and allowed to set for this initial period, the ballet pointe shoe is removed and the plastic film peeled off. The custom toe cap has now taken the three dimensional shape and topography of the interior of the pointe shoe in the platform region as well as that of the relatively shorter toes. The custom toe cap may then be gently removed by peeling it off the ends of the toes. At this point the silicone rubber compound has cured to a dimensionally stable state but further time should be allowed for curing depending on the particular compound utilized for the purpose of dispelling any odors associated with the curing process. The total curing of the toe cap may range from 20 minutes to several days. Although the foregoing method steps have been described relative to the molding of a single toe cap, toe caps for both feet will usually be fabricated simultaneously since both feet are usually involved in the pointe position and simultaneous fitting is more convenient.

Once the custom formed toe cap or toe caps have been allowed to finally cure they will be in the original unmodified shape such as depicted in FIG. 3. The dancer then places the unmodified toe cap over the respective toes and pulls her leotards or tights over the toe cap and slides the foot with the toe cap in place into the pointe shoe and laces up the pointe shoe in the usual manner. By going up into the pointe position on a firm surface the dancer is able to detect or feel any areas of the toe cap that are too thick, too thin, too heavy or too irritating to the foot. The material of the toe cap may be smoothed or reduced by any well known hand tool such as a grinding wheel or a hand-held Dremel moto-tool. Likewise, material, i.e. silicone rubber compound in this case, may be added to build up any area requiring it according to the comfort dictates of the dancer. This process may be repeated as many times as necessary in order to obtain a toe cap which is comfortable to the user and functions to provide the support and weight distribution required.

The normal manner of using the custom toe cap for ballet pointe shoes involves placing the custom toe cap, fabricated as described, over the corresponding toes it was originally molded from and holding it in place by either placing a strip of paper tape over the toe cap and adjacent skin of the foot or, more commonly, by sliding the dancer's leotards or tights over the toe cap to hold it in place. The ballet dancer then slides the foot inside the ballet pointe shoe and laces the pointe shoe in the usual manner. The custom toe cap now is in place inside the ballet pointe shoe and will not move out of position. When the ballet dancer goes onto the ballet pointe position with the custom toe cap inside the ballet pointe shoe, a stable weight-bearing platform is provided across the tips of all the toes. In essence, the custom toe cap has brought the weight-bearing platform up to the tips of the relatively shorter toes. With the toe cap inside the ballet pointe shoe, the relatively longer toes no longer have a tendency to buckle or bend due to excess weight-bearing on the tips of those toes.

With the custom toe caps inside the ballet pointe shoes the dancer has better balance and weight distribution across the tips of the toes and therefore experiences improved dance technique. A dancer who is not properly balanced in the pointe position is considered to have poor technique. A foot that compensates for uneven weight distribution by "sickling out" is attempting to equalize weight-bearing forces across the tips of all the toes but with the undesirable effect of a tilted foot position. Because the ballet dancer's foot no longer tilts to one side, pain and injury due to sickling out are either prevented, reduced or eliminated.

When the ballet dancer finishes dancing, she may leave the custom toe cap inside the ballet pointe shoe or she may take it out and carry it in her pocket or store it in a safe place. The custom toe caps are lightweight, compact and transportable. Usually one toe cap is made for each foot to go into each ballet pointe shoe. It is possible of course that a dancer might require only one toe cap depending on the individual lengths of her toes. Additionally, since the custom toe caps were made to fit the individual ballerina's toes and ballet pointe shoes, they might not work in a different size ballet pointe shoe or in a differently constructed ballet pointe shoe.

Although the present invention has been described and illustrated with respect to a specific embodiment thereof, it will be apparent to those skilled in the art that modifications to the structures and modifications of the method steps may be made without departing from the spirit of the invention or from the scope of the appended claims.

What is claimed is:

1. In a ballet pointe shoe having shoe walls and a toe support platform surface in the toe end thereof for contacting a dancing surface and being in vertical weight-bearing contact with the ends of the wearer's toes in the pointe position, wherein the wearer's toes are not uniform in length comprising longer and shorter toes with irregular surface features creating voids between the ends of the shorter toes, the support platform surface and the shoe walls, a toe cap comprising;

a toe cap body formed by molding within a ballet pointe shoe to be fitted utilizing a moldable uncured compound mixed with a setting agent and having an uncured state comprising a putty-like consistency and a cured state comprising a solid weight-bearing mass having a yieldable surface, said toe cap body being shaped by pointed position pressure exerted by a dancer's foot during a period sufficient to cause curing of the compound so as to fill the entire space between the ends of the individual shorter toes, said toe support platform surface and the walls of the shoe adjacent said shorter toes, the surface of said toe cap body being molded to conform exactly to the irregular surface features of each said shorter toes and providing an interface with the toe support platform surface and the adjacent shoe walls, whereby said toe cap may be worn inside the ballet pointe shoe with said toe cap distributing the vertical weight-bearing force in the pointe position across the ends of all toes of the dancer's foot.

2. The custom toe cap of claim 1 including:

a fabric foot covering, said toe cap being located inside said fabric foot covering and in skin contact with the wearer's toes, said foot covering serving to hold said toe cap in position for initial insertion into the ballet pointe shoe.

3. The custom toe cap of claim 1 wherein;

said toe cap body has a durometer value of not less than 20 on the Shore-A-Hardness scale.

4. The custom toe cap of claim 3 wherein;

said toe cap body has a durometer value in the range of 20–40 on the Shore-A-Hardness scale.

5. The custom toe cap of claim 4 wherein;

said toe cap body comprises a silicon rubber-based compound.

6. A method of distributing the vertical weight-bearing forces across the ends of the toes of a ballet dancer's foot in the pointe position within a ballet pointe shoe, said shoe having shoe walls and a toe support platform surface in the toe end thereof, the dancer's toes including longer and shorter toes creating voids between the ends of the shorter toes, the support platform surface and the shoe walls, including steps of;

applying a quantity of moldable uncured compound directly to the ends of the shorter toes, said compound being mixed with a setting agent and having an uncured state comprising a putty-like consistency and a cured state comprising a solid weight-bearing unitary mass having a yieldable surface, covering the foot and said uncured moldable compound with a plastic film, inserting the foot thus covered into a ballet pointe shoe to be fitted, applying pointe position pressure and standing pressure on said foot within the shoe to forcibly mold said compound to fill the entire space between the ends of said shorter toes, said support platform surface and the shoe wall to form an interface therebetween, for a period of time sufficient to cause said compound to initially cure into said solid weight-bearing unitary mass, removing said plastic film and allowing said compound to completely cure forming a removable toe cap, whereby said toe cap may be worn inside the ballet pointe shoe thus fitted to distribute the vertical weight-bearing force in the pointe position across the ends of all toes of the dancer's foot.

7. The method according to claim 6 wherein;

said weight-bearing unitary mass has a durometer value of not less than 20 on the Shore-A-Hardness scale.

8. The method according to claim 7 wherein;

said weight-bearing unitary mass has a durometer value in the range of 20–40 on the Shore-A-Hardness scale.

9. The method according to claim 8 wherein;

said weight-bearing unitary mass comprises a silicone rubber-based compound.

10. A method of forming a custom toe cap body for the irregular surfaces of a dancer's toes in a ballet point shoe comprising the steps of;

forming the toe cap body within a ballet pointe shoe having shoe walls and a vertical weight-bearing support surface in the toe end thereof by utilizing a moldable compound mixed with a setting agent, said compound having an uncured state comprising a putty-like consistency and a cured state comprising a solid weight-bearing unitary mass, first applying said uncured compound to the ends of a dancer's toes, then inserting the dancer's foot into the pointe shoe to be fitted, and then applying pointe position pressure with the dancer's foot to forcibly mold said compound to completely fill the space between the irregular surfaces of the toes, the support surface and the shoe walls to form an interface therebetween, and maintaining said pointe position pressure for sufficient period of time to cause said compound to initially cure into said solid weight-bearing unitary mass.

11. A custom toe cap formed according to the method of claim 10.

12. The custom toe cap of claim 11 wherein;

said weight-bearing unitary mass has a durometer value of not less than 20 on the Shore-A-Hardness scale.

13. The custom toe cap of claim 12 wherein;

said weight-bearing unitary mass has a durometer value in the range of 20–40 on the Shore-A-Hardness scale.

14. The custom toe cap of claim 13 wherein;

said weight-bearing unitary mass comprises a two component silicone rubber-based compound.

* * * * *